US005088555A

United States Patent [19]

Shu

[11] Patent Number: 5,088,555

[45] Date of Patent: Feb. 18, 1992

[54] CONSOLIDATION AGENT AND METHOD

[75] Inventor: Paul Shu, Cranbury, N.J.

[73] Assignee: Mobil Oil Corporation, Fairfax, Va.

[21] Appl. No.: 622,586

[22] Filed: Dec. 3, 1990

[51] Int. Cl.[5] ..... E21B 33/138

[52] U.S. Cl. ..... 166/292; 166/297; 166/300; 405/263

[58] Field of Search ..... 166/270, 292, 293, 297, 166/300; 405/263

[56] References Cited

U.S. PATENT DOCUMENTS

| | | | |
|---|---|---|---|
| 2,025,948 | 12/1935 | Jorgensen | 405/263 |
| 2,238,930 | 4/1941 | Chamberlain et al. | 166/292 |
| 3,155,160 | 11/1964 | Craig, Jr. et al. . | |
| 3,175,611 | 3/1965 | Hower | 166/292 |
| 3,202,214 | 8/1965 | McLaughlin | 166/292 |
| 3,259,186 | 7/1966 | Dietz . | |
| 3,437,143 | 4/1969 | Cook | 166/285 |
| 3,908,388 | 9/1975 | De Vries | 405/264 |
| 4,257,650 | 3/1981 | Allen | 299/2 |
| 4,489,783 | 12/1984 | Shu | 166/272 |
| 4,549,608 | 10/1985 | Stowe et al. | 166/280 |

*Primary Examiner*—George A. Suchfield
*Attorney, Agent, or Firm*—Alexander J. McKillop; Charles J. Speciale; Charles A. Malone

[57] ABSTRACT

A sand consolidation method is provided for use in a borehole having an unconsolidated or loosely consolidated oil or gas reservoir which is likely to introduce substantial amounts of sand into the borehole and cause caving. After perforating the borehole's casing at an interval of the formation where sand will be produced, an aqueous solution of potassium silicate is injected into said interval. Thereafter, an alcoholic solution of hydrated calcium chloride is injected into the interval. A permeability retaining calcium silicate cement is formed in the interval. Injection of the potassium silicate and hydrated calcium chloride solutions is continued until the interval has been consolidated by the calcium silicate cement to an extent sufficient to prevent sand migration and thereby prevent caving.

10 Claims, 1 Drawing Sheet

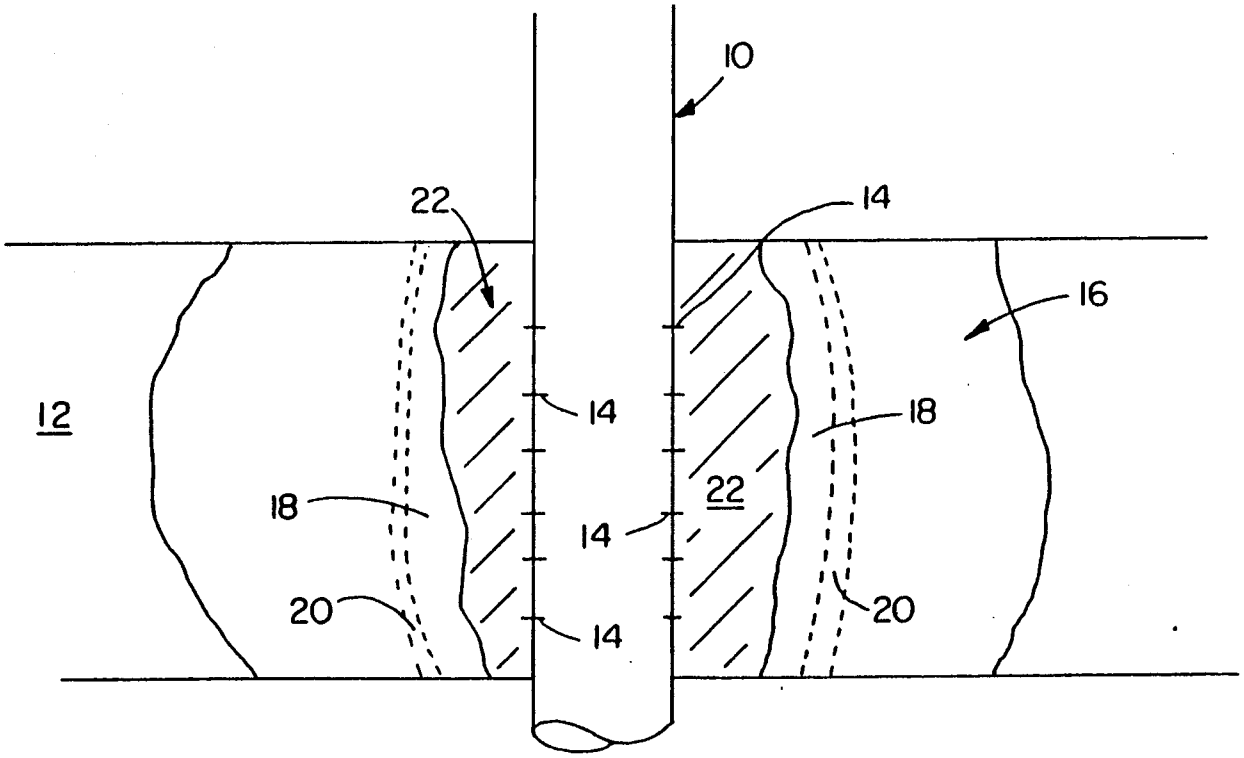
10
14
16
18
20
22
12

CONSOLIDATION AGENT AND METHOD

FIELD OF THE INVENTION

This invention relates to the consolidation of subterranean formations and, more particularly, to a method of introducing two consolidating fluids into a zone of an incompetent formation so as to form a cement adjacent to a well penetrating the formation. The method of this invention is especially useful in promoting more uniform fluid injection patterns in a consolidated interval of the formation so as to tolerate high pH steam when conducting a steam-flooding or fire-flooding enhanced oil recovery operation.

BACKGROUND OF THE INVENTION

It is well known in the art that wells in sandy, oil-bearing formations are frequently difficult to operate because the sand in the formation is poorly consolidated and tends to flow into the well with the oil. This "sand production" is a serious problem because the sand causes erosion and premature wearing out of the pumping equipment, and is a nuisance to remove from the oil at a later point in the production operation. In some wells, particularly in the Saskatchewan area of Canada, oil with sand suspended therein must be pumped into large tanks for storage so that sand can settle out. Frequently, the oil can then only be removed from the upper half of the tank because the lower half of the tank is full of sand. This, too, must be removed at some time and pumped out. Moreover, fine sand is not always removed by this method and this causes substantial problems later in production operations which can lead to rejection of sand-bearing oil by the pipeline operator. Also, removal of oil from tar sand formations is particularly challenging because high temperature steam with high pH is used. A suitable consolidating agent must withstand a similar harsh environment. In order to prevent caving around a wellbore and damage thereto, during the production of oil from a tar sand formation, it is often necessary to consolidate the formation.

Steam or fire stimulation recovery techniques are used to increase production from viscous oil-bearing formations. In steam stimulation techniques, steam is used to heat a section of the formation adjacent to a wellbore so that production rates are increased through lowered oil viscosities.

In a typical conventional steam stimulation injection cycle, steam is injected into a desired section of a reservoir or formation. A shut-in or soak phase may follow, in which thermal energy diffuses through the formation. A production phase follows in which oil is produced until oil production rates decrease to an uneconomical amount. Subsequently, injection cycles are often used to increase recovery. During the production phase, sand flowing from a subsurface formation may leave therein a cavity which may result in caving of the formation and collapse of the casing.

Therefore, what is needed is a method to consolidate a formation so as to prevent caving of an interval near the wellbore which interval requires stability to withstand high pH steam during a steam stimulation or thermal oil recovery process.

SUMMARY OF THE INVENTION

This invention is directed to a method for consolidating sand in an unconsolidated or loosely consolidated oil or hydrocarbonaceous fluid containing formation or reservoir. In the practice of this invention, an alkali metal silicate solution is injected into an interval of the formation where sand consolidation is desired. The alkali metal silicate solution enters the interval through perforations made in a cased well penetrating the formation. By use of a mechanical packer, penetration of the fluid into the interval can be controlled. As the alkali metal silicate enters the interval, it saturates said interval.

After a desired volume of silicate has been placed into the interval requiring sand consolidation, an alcoholic solution of hydrated calcium chloride is next injected into the interval. Upon coming into contact with the alkali metal silicate solution which has saturated the interval, calcium chloride reacts with the alkali metal silicate to form calcium silicate cement in the interval being treated. The calcium silicate cement which is formed is stable at high pH's and temperatures in excess of about 400° F. These steps can be repeated until the interval has been consolidated to the extent desired.

Once the treated interval has been consolidated to a desired strength, a steam-flooding or other thermal enhanced oil recovery method can be used to produce hydrocarbonaceous fluids to the surface. By controlling the concentration and rate of injection of the alkali metal silicate and the calcium chloride which are injected into the interval being treated, the consolidation strength of the formation can be tailored as desired.

It is therefore an object of this invention to provide for an in-situ calcium silicate composition for consolidating an interval of a formation which composition is more natural to a formation's environment.

It is another object of this invention to provide for a composition which will ensure an even flow front and a homogeneous consolidation of an interval of a formation requiring treatment.

It is yet another object of this invention to consolidate an unconsolidated or loosely consolidated interval in a formation to prevent caving and damage to an adjacent wellbore.

It is a still yet further object of this invention to provide for a method to obtain a desired consolidation within an interval of a formation which can be reversed by treating the interval with a strong acid.

It is an even still yet further object of this invention to provide for a formation consolidation agent which is resistant to high temperatures and high pH's.

It is yet an even still further object of this invention to provide for a consolidation composition lacking a particulate matter therein which matter might prevent penetration of the composition in an area requiring consolidation, flow alteration, or pore size reduction.

BRIEF DESCRIPTION OF THE DRAWING

The drawing is a schematic representation showing how the composition is injected into the formation so as to consolidate sand grains while maintaining the porosity of the formation.

DESCRIPTION OF THE PREFERRED EMBODIMENT

In the practice of this invention, as shown in the drawing, an aqueous alkaline metal silicate slug 16 is injected into well 10 where it enters formation 12 via perforations 14. A method for perforating a wellbore is disclosed in U.S. Pat. No. 3,437,143 which issued to Cook on Apr. 8, 1969. This patent is hereby incorporated by reference herein. As the aqueous slug containing the alkaline metal silicate proceeds through formation 12, it fills the pores in the formation. Afterwards, a second slug containing a solvent with a soluble calcium salt mixed therein is injected into the formation whereupon it displaces the first aqueous plug. An interface 20 is formed between the aqueous phase 16 and solvent phase 18. As the slugs meet, the alkali metal silicate and solvent containing the calcium salt react simultaneously at the interface between the two slugs to form a silica cement. Since the two solvents, water and solvent, are miscible to form a single injection phase, a fairly even flow front is achieved.

As interface 20 proceeds through formation 12 and displaces aqueous alkali metal slug 16, a cementing reaction takes place so as to bind sand grains in the formation thereby forming a consolidated porous zone 22. Although the sand grains are consolidated, a cement is formed which results in a substantially high retention of the formation's permeability. Retention of the formation's permeability allows solvent phase 18 to move continually through the formation while cement is being formed at the interface.

Injection of alkali-metal slug 16 and solvent slug 18 containing the calcium salt can be continued until the formation has been consolidated to a strength sufficient to prevent caving and damage to the wellbore. As will be understood by those skilled in the art, the amount of components utilized is formation dependent and may vary from formation to formation. Core samples obtained from the interval to be treated can be tested to determine the required pore size and amount of cement needed. U.S. Pat. No. 4,549,608 which issued to Stowe et al. teaches a method of sand control where clay particles are stabilized along a face of a fracture. This patent is incorporated by reference herein.

After an interval of the formation has been consolidated, that interval or another adjacent to the wellbore can be perforated and a thermal enhanced oil recovery method conducted therein. One such method when steamflooding is utilized is disclosed in U.S. Pat. No. 4,257,650. This method is incorporated by reference herein. Other methods which can be utilized herein are discussed in U.S. Pat. Nos. 3,259,186, 3,155,160, and 4,489,783. These references are incorporated by reference herein.

Alkali metal silicates having a $SiO_2/M_2O$ molar ratio of about 0.5 to about 2 are suitable for forming a stable alkali silicate cement. The metal (M) which is utilized herein comprises sodium, potassium, lithium, or ammonium ions. Preferably, the $SiO_2/M_2O$ molar ratio is in the range of about 0.5 to about 1. The concentration of the silicate solution is about 10 to about 60 wt. percent, preferably 20 to about 50 wt. percent. As will be understood by those skilled in the art, the exact concentration should be determined for each application. In general, concentrated silicate solutions are more viscous and form a stronger consolidation due to a higher content of solids.

The viscosity of the silicate solution can also determine the extent to which it will enter an interval of the formation to be treated. In those cases where it is not possible to control the viscosity of the silicate solution and preclude entry into a lower permeability zone, a mechanical packer may be used. The calcium silicate cement which is formed can withstand pH's greater than about 10 and temperatures in excess of about 500° F. The preferred silicates are sodium and potassium. Potassium is preferred over sodium silicate because of its lower viscosity. Fumed silica, colloidal silica, or other alkalines can be added to modify the $SiO_2/M_2O$ molar ratio of commercial silicate. Colloidal silicate can be used alone or suspended in the alkali metal silicate as a means of modifying silicate content, pH, and/or $SiO_2$ content.

The calcium salt which can be used herein is one which is soluble in alcohol. Calcium chloride hydrate is preferred. However, chelated calcium forms can also be used. Methanol and ethanol are the alcohols preferred for use herein. This is due to their high availability. Higher alcohols also can be utilized, as well as other solvents capable of dissolving calcium salts and chelates. Solvents such as ketones, tetrahydrofuran (THF), and dimethyl sulfoxide (DMSO) can be utilized. The concentration of calcium chloride hydrate should be in the range of about 10 to about 40 wt. percent, preferably 20 to about 30 wt. percent. Of course, enough calcium chloride solution should be used to complete the reaction with the alkali metal silicate.

In order to show the effectiveness of this method, consolidated sandpacks were prepared by mixing 40/60 mesh sand with appropriate amounts of potassium silicate solutions of various $SiO_2/K_2O$ molar ratios to a desired potassium silicate content. One pore volume of $CaCl_2 \cdot 2H_2O$, 30% in ethanol, was then flowed through the potassium silicate loaded sandpack to form consolidated sandpacks with reduced permeabilities. A typical non-consolidated 40/60 mesh sandpack has a permeability of 60 darcies. Resistance to alkali of these consolidated sand cores was tested in a 10% NaOH solution at 195° F. for 16 hours to observe the integrity of the cores. If a core remained intact, then its physical strength was tested by an ultrasonic generator at 120 watts output for five minutes under water. Core strength was evaluated by the weight of loose sand produced per unit core surface area exposed to ultrasound. Less sand is produced with a stronger core. The following examples show the effectiveness of the method.

| Example | $SiO_2/K_2O$ | Potassium Silicate Content, % | Sand Production $g/in^2$ | Darcy Permeability |
|---|---|---|---|---|
| 1 | 1.6 | 3 | 3.1 | 0.3–0.9 |
| 2 | 1 | 2.2 | 7.5 | 0.9 |
| 3 | 1 | 3.3 | 1.4 | 0.3–1.5 |
| 4 | 0.5 | 2.5 | 2.4 | NA |
| 5 | 0.5 | 3.75 | 1.1 | NA |

EXAMPLE 6

One pore volume of 45% potassium silicate with a $SiO_2/K_2O$ ratio of 1, followed by another pore volume of 30% $CaCl_2 \cdot 2H_2O$ in ethanol, were flowed through a 40/60 sandpack, one inch in diameter and six inches long, to achieve a strong consolidation.

EXAMPLE 7

The same procedure as in Example 6 was followed here, except a 50% potassium silicate with a $SiO_2/K_2O$ ratio of 0.5 was used. A consolidated core was produced.

EXAMPLE 8

In this example, a one-inch diameter by 12-inch long 12/20 mesh sand pack was utilized. The purpose of this procedure was to evaluate the ability of the cement to withstand a high pH and high temperature environment. Flow experiments were performed by first injecting an aqueous potassium silicate solution into the 12/20 sand pack. This was followed by injection of a calcium chloride/ethanol solution. Calcium silicate cement deposited in the pack was formed by an instantaneous contact reaction of the flowing calcium chloride solution with the potassium silicate solution at room temperature.

A residual permeability of 34 md was obtained after repeating the injection procedure three times. The cemented pack showed excellent thermal and high pH stability. After 300 PV of caustic steamflooding at 500° F. and a resultant pH of 11, the residual permeability of the cemented pack was about 60 md. This showed that the cement has great potential for steam flood control applications due to its stability to caustic steam. Potassium silicate used herein was about 40 to about 50 percent by weight. The calcium chloride/ethanol solution was made by placing 30 wt. % of $CaCl_2 \cdot 2H_2O$ into 7 oz. of 100% ethanol.

Although the present invention has been described with preferred embodiments, it is to be understood that modifications and variations may be resorted to without departing from the spirit and scope of this invention, as those skilled in the art readily understand. Such variations and modifications are considered to be within the purview and scope of the appended claims.

What is claimed:

1. A sand consolidating method for an unconsolidated or loosely consolidated formation comprising:

a) perforating a cased borehole at an interval expected to produce fines or sand when producing hydrocarbonaceous fluids from said interval;

b) injecting an aqueous solution of an alkali metal silicate into said interval through perforations contained in the borehole which solution is of a strength sufficient to react with an alcoholic solution of calcium salt to form a permeability retention cement; and c) injecting thereafter a solvent containing a calcium salt into said interval via the perforations in an amount sufficient to react with the alkali metal silicate so as to form a calcium silicate cement with permeability retention characteristics whereupon the interval is consolidated in a manner sufficient to prevent formation sand from being produced from the formation during the production of hydrocarbonaceous fluids, which solvent is selected from a member of the group consisting of methanol, ethanol, higher alcohols, ketones, tetrahydrofuran, and dimethyl sulfoxide.

2. The method as recited in claim 1 where the alkali metal silicate comprises ions of sodium, potassium, lithium, or ammonium and mixtures thereof.

3. The method as recited in claim 1 where the alkali metal silicate has a silicon dioxide to metal oxide molar ratio of about 0.5 to about 2.

4. The method as recited in claim 1 where said calcium salt is selected from a member of the group consisting of calcium chloride hydrate, and chelated calcium.

5. The method as recited in claim 1 where the silicate is contained in the solution in an amount of from about 10 to about 60 weight percent.

6. The method as recited in claim 1 where the calcium salt is contained in said solution in an amount of about 10 to about 40 weight percent.

7. The method as recited in claim 1 where steps b) and c) are repeated until the porosity of the interval has been reduced to the extent desired.

8. The method as recited in claim 1 where said calcium silicate withstands temperatures in excess of about 500 degrees F.

9. The method as recited in claim 1 where the calcium silicate withstands a temperature in excess of about 500 degrees F. and a pH in excess of about 10.

10. The method as recited in claim 1 where the silicon dioxide to metal oxide molar ratio is less than about 2.

* * * * *